United States Patent [19]

Kiyooka et al.

[11] Patent Number: 4,494,490

[45] Date of Patent: Jan. 22, 1985

[54] CYLINDER COVER

[75] Inventors: Katsumi Kiyooka, Warabi; Atsushi Harada, Kokubunji; Kiyoshi Anbo, Hiratsuka, all of Japan

[73] Assignee: Komatsu Zenoah Co., Tokyo, Japan

[21] Appl. No.: 479,570

[22] Filed: Mar. 28, 1983

[30] Foreign Application Priority Data

Mar. 31, 1982 [JP] Japan ..... 57-044739[U]

[51] Int. Cl.[3] ..... F01P 1/00

[52] U.S. Cl. ..... 123/41.56; 123/41.65; 123/41.7; 123/195 C; 123/198 E

[58] Field of Search ..... 123/195 R, 195 C, 198 E, 123/41.7, 41.65, 149 R, 41.49, 41.52, 41.54, 41.56, 41.62; 181/204

[56] References Cited

U.S. PATENT DOCUMENTS

| | | | |
|---|---|---|---|
| 1,342,976 | 6/1920 | Thompson | 123/41.65 |
| 2,157,666 | 5/1939 | Jacobi | 123/41.65 |
| 2,533,487 | 12/1950 | Maurer et al. | 123/41.65 |
| 2,549,482 | 4/1951 | Kiekhaefer | 123/41.65 |
| 3,157,211 | 11/1964 | Wiig | 123/41.65 |
| 3,259,752 | 7/1966 | Honda | 123/41.62 |
| 4,079,721 | 3/1978 | Brown | 123/198 DC |

*Primary Examiner*—Craig R. Feinberg
*Assistant Examiner*—David A. Okonsky
*Attorney, Agent, or Firm*—Jones & Askew

[57] ABSTRACT

A cylinder cover being connected to a fan cover, covering the top section of a cylinder. The cylinder cover covering the cylinder of an engine has an opening section at a position close to the fan cover. The opening section of the cylinder cover is covered by a freely removable cover section being secured to the cylinder cover.

5 Claims, 4 Drawing Figures

CYLINDER COVER

BACKGROUND OF THE INVENTION

The present invention relates to a cylinder cover which is connected with the fan cover covering the fan, and which covers the top section of a cylinder.

Conventionally, the blast generated by the engine fan is guided to the side section of the cylinder by the fan cover and the cylinder cover connected with the fan cover to cool the cylinder. On the blast way inside this fan cover the coil is disposed such that it induces electromotive force in response to the magnetic wheel which rotates in conjunction with the fan, whereby the refuse contained in blast adheres to the coil and the cylinder fin facing the coil and reduces the cooling efficiency of blast. Since it is necessary to remove whole of the cylinder cover from the engine to clean the refuse adhering thereto, the cleaning work is burdensome.

SUMMARY OF THE INVENTION

An object of the invention is to provide a cylinder cover that enables cleaning of both the coil and the cylinder fin section facing the coil which are liable to collect refuse merely by taking off only the cover section of cylinder cover without removing the whole of cylinder cover which is burdensome.

Another object of the invention is to provide a cylinder cover which is superior in blast cooling efficiency.

Briefly described, the above objects can be embodied by providing the cylinder cover with an opening section close to the fan cover and providing the cylinder cover with a cover section for covering the said opening section by securing removably the cover section to the cylider cover.

The foregoing and other objects, features, and advantages of the invention will be apparent from the following more particular description of a preferred embodiment of the invention, as illustrated in the accompanying drawings.

DETAILED DESCRIPTION OF THE PREFERRED EMBODIMENT

Figure 1:
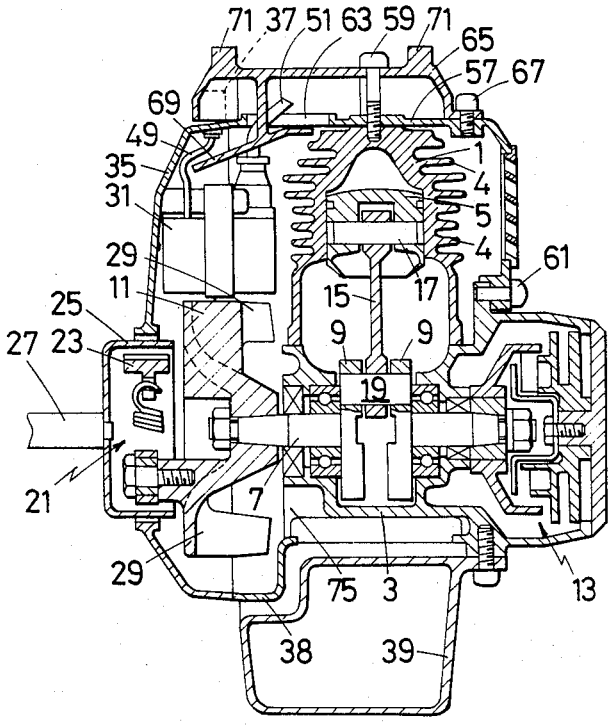
FIG. 1 is a side sectional view of a cylinder in accordance with the invention.
Figure 2:
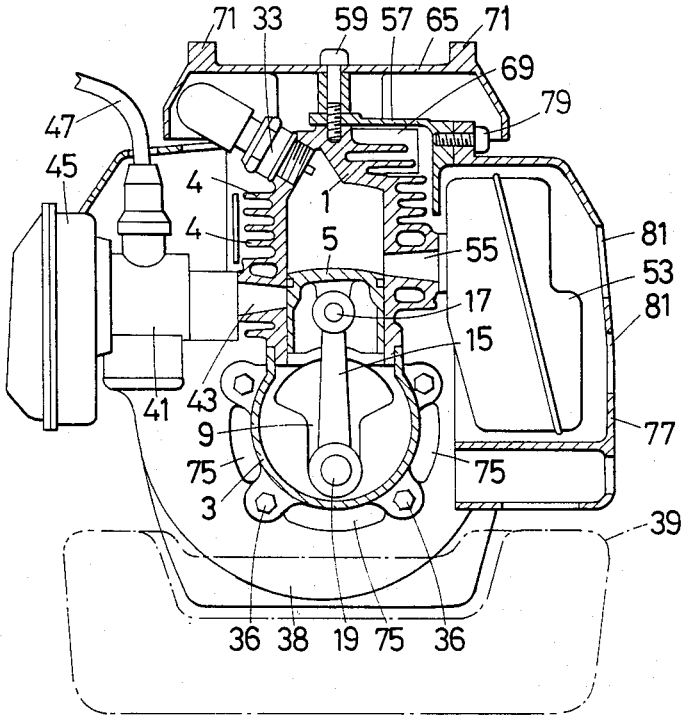
FIG. 2 is a front sectional view of the cylinder.

In FIGS. 1 and 2, a cylinder 1 is secured to the upper surface of a crank case 3 of the engine, the outer side surface thereof is provided circumferentially with fins 4, and a piston 5 is disposed inside the cylinder by making it fit in the inner surface of the cylinder so that it can slide vertically and freely along the inner surface of the cylinder. A crank shaft 7 is supported by the crank case 3 so as to allow free revolution thereof, a crank 9 is secured to the middle section thereof, a magnet wheel 11 is secured to one end of the crank 9, and a recoil starter 13 for engine starter is secured to the other end of the crank 9. A coupling rod 15 is connected rotatably to the piston 5 by a piston pin 17 at the upper end of the rod 15 and to a crank pin 19 secured at the crank 9 at the lower end of the rod 15. A reference numeral 21 shows a centrifugal clutch disposed on the exterior side surface of the magnet wheel 11, and when the rotating speed of the centrifugal clutch reaches a predetermined value, a shoe 23 touches clutch drum 25 disposed outward to drive a power transmission shaft 27. A reference numeral 29 shows a fan disposed inside the magnet wheel 11. A reference numeral 31 shows a coil disposed over and close to the magnet wheel 11 which induces a primary current in response to the magnet (not shown) embedded in the outer circumference section of the magnet wheel 11 when the starter 13 is operated and further induces a secondary current in response to the primary current which is discharged to a ignition plug 33 to cause firing. A reference numeral 35 shows a fan cover which covers the fan 29 and the coil 31 and is secured to a fan case 38 connected to the crank case 3 by bolts 36 (FIG. 2). A reference numeral 37 shows a switch secured to the upper surface of the fan cover 35 for making short circuit of the primary circuit in the coil 31 to stop ignition of the ignition plug 33. A reference numeral 39 shows a fuel tank disposed under the crank case 3, and a reference numeral 41 a carbureter communicating with an intake port 43, a reference numeral 45 an air cleaner, and a reference numeral 47 a throttle wire, respectively. A reference numeral 49 shows a wire for stopping ignition, a reference numeral 51 an ignition wire connecting the coil 31 and the ignition plug 33, and a reference numeral 53 a muffler communicationg with an exhaust port 55. A reference numeral 57 shows a cylinder cover secured to the cylinder 1 by screws 59 and 61 and disposed so as to cover the upper and side sections of the cylinder 1. A reference numeral 63 shows an opening section disposed at the position on the cylinder cover 57 close to the fan cover 35, and a reference numeral 65 shows a cover section covering the opening section 63 and the ignition plug 33 which is secured to the cylinder cover 57 by screws 67 and 59 so as to be removable freely. A reference numeral 69 shows a blast guide section secured to cover the section 65 and is formed into such a shape as to guide the blast generated by the fan 29 to the outer circumference of the cylinder 1.

Figure 3:
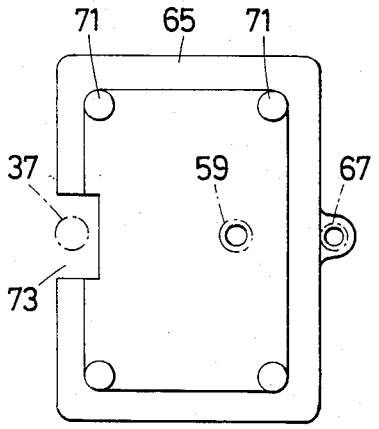
FIG. 3 is a plan view of a cylinder cover of an embodiment of the invention.
Figure 4:
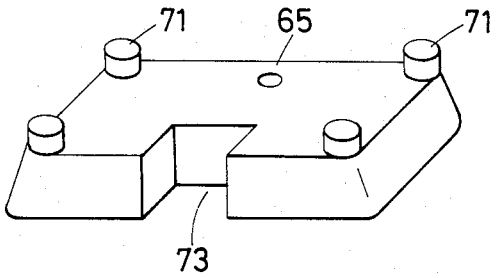
FIG. 4 is a perspective view of the cylinder cover.

A reference numeral 71 (FIGS. 3 and 4) is foot sections disposed on the upper surface of the cover section 65 so as to protrude therefrom for supporting the engine to the ground when the engine is turned upside down. A reference numeral 73 (FIGS. 3 and 4) shows a hollow section made by notching an edge section on the side of the fan cover 35 for storing and protecting the ignition stop switch 37 disposed at the upper section of the fan cover 35. A reference numeral 75 shows blast inlet holes for the fan 29 and is open to the fan case 38 of the crank case 3. A reference numeral 77 shows a muffler cover secured to the cylinder cover 57 by the screw 79, is disposed so as to cover circumferentially the outer surface of the muffler 53, and is provided with blast exhausting holes 81.

In the above embodiment, when the engine is started by the recoil starter device 13 and the rotating speed of the engine is increased, the shoe 23 of centrifugal clutch 21 touches the clutch drum 25 to drive the power transmission shaft 27. The blast generated by the fan 29 passes along the outer circumference of the coil 31, that of the cylinder 1, that of the muffler 53 to cool the coil 31, the cylinder 1, and the muffler 53, and is let out to atmosphere through the blast exhausting holes 81 on the muffler cover 77. Although the refuse contained in this blast is much stuck and collected on the coil 31 and the fins 4 of the cylinder 1 facing the coil 31, the refuse thus stuck and collected can easily be removed from the opening section 63 by taking off the cover section 65.

The engine, which is constituted as described above, makes it easy to remove the refuse stuck to the coil and the cylinder fin facing the coil and makes it possible to protect lowering of the blast cooling efficiency.

Further, if the cover section is formed into such a shape as to cover the ignition plug in the cylinder, it can prevent firing failure of the ignition plug due to wet by rain, the burning of worker's hand accidentally touching the ignition plug, and the damage of the ignition plug.

Furthermore, if the cover section is formed into such a shape as to support the engine when the engine is turned upside down, it can protect the damage of the ignition plug when the engine is laid on the ground with the engine upside down in order to replace the cutting blades, and allows the engine to be laid on the ground stably, making it easy to replace the cutting blades.

Also, if a blast guide section is formed in part of the cover section for guiding the blast generated by the fan to the outer circumference of the cylinder, it is possible to dispose a blast guide surface having an appropriate shape and further to remove the said blast guide section together with the said cover section, which is useful to avoid hindrance to cleaning work.

Moreover, if one edge of the cover section is provided with a hollow section for placing a switch for stopping the engine therein, the switch can be disposed on the top of the fan cover whereby the switch an easily be operated from any side, left or right, an erroneous switch operation can be prevented because the switch is protected by the cylinder cover.

It is to be understood that the invention is not limited to the aforementioned embodiment but may be otherwise variously embodied. It is also obvious that the numerals in the appended claims do not limit the technological scope of the invention.

What is claimed is:

1. Cylinder cover apparatus for use with an air-cooled internal combustion engine having a cylinder and a fan, the cylinder cover apparatus comprising:

a fan cover mounted with the engine in spaced apart relation to the cylinder so as to define an air flow passage guiding a flow of air from the fan to cool the exterior wall of the cylinder;

said fan cover at one end thereof defining an opening leading to said cylinder exterior wall from outside the fan cover, so that an accumulation of dirt on the cylinder exterior wall can be removed by access through said opening, and a cover member detachably secured to the engine to block said opening and thereby prevent the air flow from escaping therethrough in normal operation of the engine, so that the cover member can be removed for access to said cylinder external wall whenever cleaning is desired wherein said cover member has an air guide section extending through said opening and engaging said air flow for guiding the air flow generated by the fan to the outer side surface of said cylinder.

2. A cylinder cover as claimed in claim 1, wherein said cover member is formed into such a shape as to cover an ignition plug mounted on said cylinder.

3. A cylinder cover as claimed in claim 1, wherein one edge section of said cover member is formed to have a hollow section in which a switch for ceasing firing can be installed.

4. Apparatus as in claim 1, further comprising:

an ignition coil operatively associated with said engine and mounted in said air flow passage downstream of the fan, so as to be cooled by said air flow; and wherein said opening is located on said fan cover in line with said coil so that dirt accumulated on the coil can be removed through the opening when said cover member is removed.

5. Apparatus as in claim 1, wherein:

said opening defined by said fan cover is located proximate an end of the cylinder; and said cover member comprises ground support means facing outwardly from said cylinder end when the cover member is attached to the engine, said ground support means providing a stable support for the engine when turned upside down.

* * * * *